United States Patent [19]

O'Brien

[11] 3,935,517

[45] Jan. 27, 1976

[54] CONSTANT CURRENT CHARGING DEVICE

[75] Inventor: John F. O'Brien, Webster, N.Y.

[73] Assignee: Xerox Corporation, Stamford, Conn.

[22] Filed: Jan. 2, 1975

[21] Appl. No.: 538,118

[52] U.S. Cl. ..... 317/262 A; 250/325

[51] Int. Cl.[2] ..... H01T 19/00

[58] Field of Search ..... 317/2 R, 262 A; 355/3; 250/324–326

[56] References Cited

UNITED STATES PATENTS

| | | | |
|---|---|---|---|
| 3,233,156 | 2/1966 | Jarvis et al. | 317/262 A |
| 3,254,215 | 5/1966 | Oliphant | 250/325 |
| 3,716,755 | 2/1973 | Marx | 317/262 A |
| 3,781,105 | 12/1973 | Meagher | 250/325 X |

*Primary Examiner*—J. D. Miller
*Assistant Examiner*—Harry E. Moose, Jr.

[57] ABSTRACT

Application of a constant density of surface charge on a dielectric medium by non-contact charging is accomplished by a rotatable charging roll having a relaxable layer surrounding a conductive axle and a protective leaky insulator overcoat layer applied to the relaxable layer. The charging roll is spaced from the dielectric medium to define an air gap of about 0.010–0.060 inch and the surface velocity of the charging roll is adjustable relative to the velocity of the moving dielectric medium. A constant current power source is coupled to the conductive axle to generate a charge buildup on the surface of the relaxable layer; part of this charge is transferred across the air gap to the surface of the dielectric medium. A blade or brush is provided to clean the charging roller as it rotates.

12 Claims, 2 Drawing Figures

CONSTANT CURRENT CHARGING DEVICE

BACKGROUND OF THE INVENTION

This invention relates to apparatus for charging a dielectric material, primarily for use in reproduction systems of the xerographic, or dry copying, type; more particularly, the invention relates to a device for laying down a constant density surface charge on a dielectric having a conductive backing, such as a photoconductive belt, web or drum.

According to the invention of C. F. Carlson as described in U.S. Pat. No. 2,297,691, there is provided a process for preparing electrophotographic pictures wherein a uniform electrostatic charge is applied to the surface of a photoconductive insulating body. This charge is selectively dissipated by exposure to a pattern of light and shadow. This exposure and its consequent dissipation of electric charge results in an electrostatic latent image which can later be developed or made visible by treatment with an electroscopic material which adheres to the electrostatic charge pattern and which, optionally, may be transferred to a second surface to form an electrophotographic print or picture. If desired, other methods of utilization of the electrostatic latent image are available and the basic invention has wide applications in many fields of use.

In electrostatographic reproductive devices it is necessary to charge a suitable photoconductive or reproductive surface with a charging potential prior to the formation thereon of the light image. Various means have been proposed for the application of the electrostatic charge or charge potential to the photoconductive insulating body of Carlson's invention; one method of operation employs, for charging the photoconductive insulating layer, a form of corona discharge wherein an adjacent electrode comprising one or more fine conductive bodies maintained at a high electric potential causes deposition of an electric charge on the adjacent surface of the photoconductive body. Examples of such corona discharge devices are described in U.S. Pat. No. 2,836,725, issued May 27, 1958, to R. G. Vyverberg and U.S. Pat. No. 2,922,883, issued Jan. 26, 1960 to E. C. Giamio, Jr. In practice, one corotron (corona discharge device) may be used to charge the photoconductor before exposure and another corotron used to charge the copy sheet during the toner transfer step. Corotrons are cheap, stable units, but they are sensitive to changes in humidity and the dielectric thickness of the insulator being charged. Thus the surface charge density produced by these devices may not always be constant or uniform.

As an alternative to the corotron charging systems, roller charging systems have been developed. Such systems are exemplified by U.S. Pat. No. 2,912,586, issued Nov. 10, 1959 to R. W. Gundlach; U.S. Pat. No. 3,043,684, issued July 10, 1962 to E. F. Mayer; U.S. Pat. No. 3,398,336, issued Aug. 20, 1968 to R. W. Martel et al. (two phase liquid film interposed between and in contact with dielectric layer and charging roller); U.S. Pat. No. 3,684,364, issued Aug. 15, 1972 to F. W. Schmidlin; and U.S. Pat. No. 3,702,482, issued Nov. 7, 1972 to Dolcimascolo et al.; and Defensive Publication T875,026, published June 30, 1970 in the name of P. T. Scharf. All of these prior art devices are concerned with contact charging, that is the charging roller is placed in contact with the surface to be charged, e.g. the photoreceptor or final support (paper) sheet.

Surface contact charging rollers of the above-mentioned prior art type are restricted to a speed of rotation which is controlled by the speed of movement of the surface to be charged. In other words, because the charging roller contacts the support member, whether it be the photoconductor drum or belt or a paper sheet to which toner is to be transferred, the surface velocity of the charging roller must be equal to the velocity of the chargeable support member. In such systems the roller materials must, in general, be tailored to the particular application and the amount of charge placed on the chargeable support is usually only controlled as a function of the voltage applied to the charging roller.

A principal object of this invention is a device which will lay down a constant density of surface charge on a material passing by the charging station at a uniform speed.

It is a further object of the present invention to combine advantageous features of both the non-contact charging corotron system and the surface contact charging roller system to provide an improved non-contact charging system.

A further object of the invention is to increase the number of parameters available for controlling the application of charge density to the chargeable support. More specifically, it is a feature of this invention to control the charge density applied to the support by either changing the voltage applied to the charging roller or by changing the rotation rate of the charging roller.

A still further feature of this invention is to provide a non-contact charging system which operates somewhat like the wire corotron but which can be continuously cleaned to avoid unwanted accumulations of contaminants that would otherwise affect the charge applied to the support.

SUMMARY OF THE INVENTION

The above and other objects are accomplished by the present invention which comprises a rotatable roll having a relaxable layer surrounding a conductive core or axle; this roll is used to lay down a constant density surface charge on a dielectric. The roll is spaced from the dielectric to provide an air gap of predetermined dimensions and rotated while the dielectric is moved past a charging station. A constant current power source is coupled to the core or axle of the roll such that current flows through the relaxable layer which, in turn, causes ionization of the gap defined between the roll and the dielectric. As the roller rotates through one quarter cycle (or 90°), the flow of current through the relaxable layer transfers most of the fraction of the applied bias originally dropped across the relaxable layer from the roller to the air gap to produce a charge on the dielectric support surface by air ionization. The relaxable layer is thick relative to the dielectric thickness of the material being charged and, therefore, has a self-leveling effect to compensate for changes in the thickness and dielectric constant of the material to be charged. To avoid damage to the relaxable layer, a thin dielectric overcoating may be provided to cover the surface of the relaxable layer.

Because the present invention utilizes a charging roller which does not contact the chargeable surface, the rotational speed of the charging roller need not be exactly the same as the speed of the chargeable surface.

This allows the charge density deposition to be controlled either by changing the applied bias or by changing the rotational rate of the charging roller, thereby changing the amount of field relaxation occurring in the relaxable layer during a quarter rotation of the roll.

In that the charging roller of this invention is spaced from the chargeable surface, it is somewhat equivalent to the corotron type of charging device. This roller differs from the corotron, however, by not requiring the corotron shield, thereby eliminating power loss due to shield current. Also, since it is rotatable, the roller can be continuously cleaned, unlike the corotron which must be removed from the machine for cleaning accumulations of dust and/or toner particles therefrom. In essence, therefore, a cleanable and relatively efficient alternative to the corotron is provided.

BRIEF DESCRIPTION OF THE DRAWING

The foregoing objects and features, as well as further features and advantages of the invention, will become more apparent from the following detailed description, read in conjunction with the appended drawing FIGS., wherein.

DESCRIPTION OF THE PREFERRED EMBODIMENT

Figure 1:
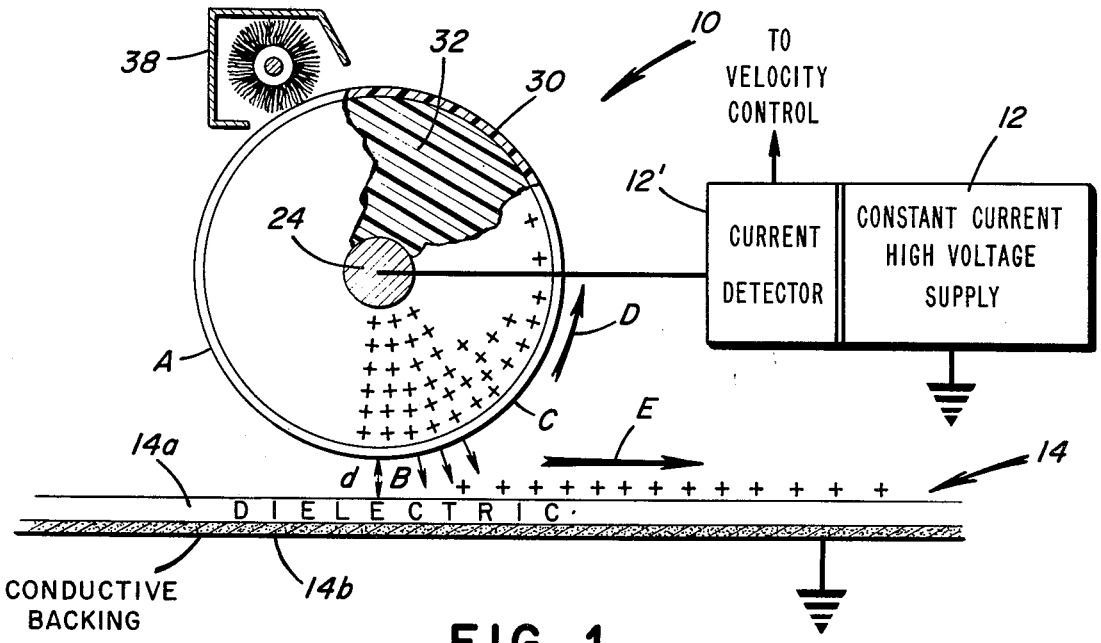
FIG. 1 schematically shows the constant current charging device of this invention.

Referring first to FIG. 1, the constant current charging device of this invention comprises a cylindrical, rotatable member 10 connected to a constant current high voltage supply 12 and mounted for rotation in the direction of arrow D. The roller 10 is mounted adjacent to but spaced a distance d from a moving dielectric medium 14 (moving in the direction of arrow E); the dielectric medium 14 may consist of a photoreceptor belt comprising a photoconductive dielectric 14*a* on a conductive backing 14*b;* the photoreceptor may alternatively consist of a photoreceptor drum or web, all of which are well known in the art. A photoreceptor belt assembly of the type to which this invention would be applicable is described in U.S. Pat. No. 3,500,694, issued Mar. 17, 1970 to H. L. Jones et al.

The non-contact charging roller system of this invention is not limited to applications where a constant current charge density is to be applied to a photoconductor surface but can also be used in place of the transfer corotron in the step of transferring toner particles from the photoreceptor to the final support member (e.g. plain paper sheet material) prior to the fusing step.

Figure 2:
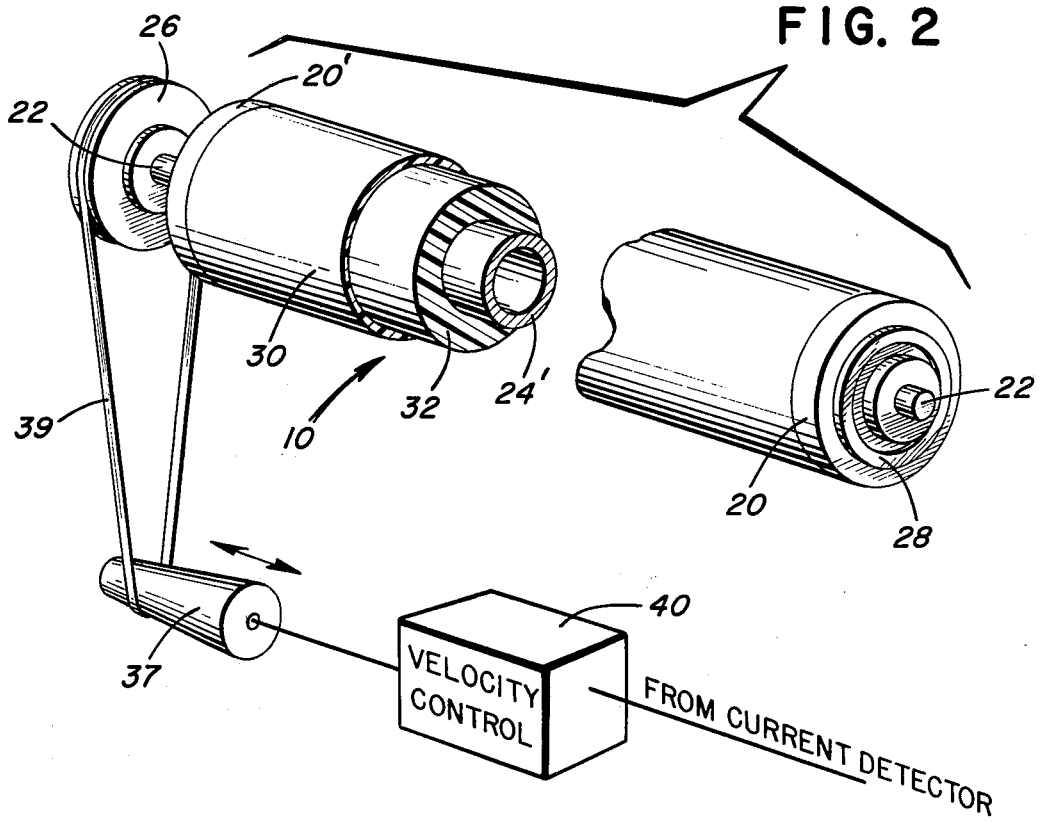
FIG. 2 shows, in cutaway view, the construction of the charging roller.

Referring now more specifically to FIG. 2, there is shown a cutaway view of the transfer roll 10 clearly illustrating the internal construction thereof. The roll is basically formed upon a rigid hollow cylinder 24 (although a solid axle, as indicated in FIG. 1, could also be used) that is fabricated of a conductive metal, such as aluminum or the like, capable of readily responding to a biasing potential placed thereon; the axle 24 has a diameter of approximately 0.125 inch. Over the core or axle 24 is placed a relatively thick relaxable intermediate layer or blanket 32 of elastomeric material. The intermediate layer may be formed of a polyurethane rubber approximately 0.25–0.50 inch in thickness and should be capable of responding rapidly, but not instantaneously, to the biasing potential to electrically impart the charge potential on the core to the outer extremities of the roll surface.

The relaxable layer 32, therefore, should have a bulk resistivity falling in a well-defined operating range selected in relation to roll diameter, supply voltage and roll velocity. In practice, the nominal roller speed is adjusted for a given relaxable roll of resistivity $\rho$ such that the current feedback control mechanism is in the middle of its operating range at nominal R.H. (30–40 percent). For the particular example described herein, the bulk resistivity of the relaxable layer can vary over the range from about $10^8$ to about $10^{13}$ ohms cm (ohms centimeter) and preferably from about $10^9$ to $10^{13}$ ohms cm. A variation in this resistivity of about two orders of magnitude, primarily as a result of static and dynamic changes in relative humidity or RH (extending generally from 5-to-10 percent RH to 85-to-100 percent RH), is observed for practical available commercial materials in this resistivity range. The preferred resistivity ranges may vary for systems designed to operate at different throughput speeds.

The relaxable layer 32 comprises a material that functionally takes a selected time period to transmit a charge from the conductive axle 24 to the interface between the relaxable layer 32 and the overcoat layer 30 sufficient to restore the interface to about the bias potential applied to the axle 24. This selected time period is that corresponding to the roller surface speed and the width of region B, i.e., roughly greater than the time any point on the transfer roller is in the region B, and is chosen to be approximately one half to one tenth of the roller revolution time. The region B is the region of closest proximity between the roller electrode 10 and the support surface 14. Functionally, this means that the magnitude of the external electric field increases significantly from location A toward location C, while the field within the relaxable layer increases at a correspondingly slower rate due to bulk relaxation of charge through the core material. Thus, a relaxable layer is one that has an external voltage profile which is non-symmetrical about region B.

Examples of the types of materials applicable for the relaxable layer are polyurethanes, polyesters, polyether urethanes; specific materials which have been used in practice include Castethane 2120-20, a polyester urethane manufactured by the Upjohn Co. and Vibrathane 6005, a polyether urethane manufactured by the Uniroyal Co.

Over the intermediate layer 32 is placed a relatively thin outer coating 30 which is also formed of an elastomeric material having a thickness of approximately 0.002–0.003 inch. In order to provide the self-leveling effect, the overcoat layer must also be relaxable, although it does not have to have quite the conductivity of the intermediate layer. Preferably the overcoat layer is a leaky insulator having a resistivity in the range of $10^{11}$ to $5 \times 10^{13}$ ohms cm. This self-leveling, or dissipation of charge, effect is desirable to prevent cyclic buildup of charge on the overcoat surface and subsequent suppression of the field in the air gap.

It is further preferred that the outer coating of the roll should be formulated of a material capable of providing a relatively smooth surface exhibiting relatively good mechanical release properties in response to the toner materials employed. This is to permit the roll to be cleaned as it rotates during charging. A polyurethane material manufactured by the DuPont Co. under the tradename "Adiprene" L315 has been found to possess the heretofore mentioned desired properties and shows extremely good release characteristics in respect to most commercially available toners.

As shown in FIG. 2, the roll member is closed at both ends by means of a pair of dielectric end caps 20 and 20' serving to electrically isolate the roll member from the supporting machine frame. Segmented shafts 22 are secured in both end caps co-axially aligned with the cylindrical core 24. The shafts are journaled for rotation within the machine frame by means of a bearing (not shown). A pulley 26, operatively connected to the machine's main drive system, is secured to one of the shafts and rotates the roll in predetermined timed relation with the moving photoconductive belt 14. The exact timing relation is determined by the density of the charge to be applied to the support. Roll velocity can be adjusted by means of a velocity feedback arrangement. For example, a constant current source including a current sensor or detector circuit is disclosed in U.S. Pat. No. 3,781,105, issued Dec. 25, 1973, to T. Meagher. The current detector 12' may have an output coupled to velocity regulating means including a conical rod 37, operatively attached to the main machine drive (not shown), which engages pulley 26 through a belt 39; the rod 37 is movable (by means of control device 40 coupled to the output of current sensor 12') to change its effective diameter relative to the pulley coupled to the roll to thereby control the rotational velocity of the roll. This type of velocity control mechanism is widely used to control the rotational rate of high fidelity record player turntables and is readily adaptable for use here.

Current flow into the relaxable layer 32 is by means of a commutator ring 28 embedded in end cap 20 and arranged to pass through the end cap to communicate electrically with the metal core 24. A commutator brush (not shown) is electrically connected to constant current source 12 and is arranged to ride in contact with the outer surface of the commutator ring 28 to provide a moving contact by which the conductive core 24 is electrically connected to the biasing source 12. An electrical connection of this type between the supply source and the roller is shown in the above-mentioned Dolcimascolo patent.

One of the important features about this invention is that the roller 10, when mounted on the machine in an operative position, does not contact the surface of the chargeable support as in the prior art; instead, as shown in FIG. 1, the charging roller 10 is mounted so as to be spaced from the support surface by a distance *d* in the range of approximately 0.010–0.060 inch. The chargeable surface 14 passes under the roll 10 at a constant velocity *v*, which normally would be in the range from about 4 to 50 ips (inches per second). At the same time, the surface velocity of the roller ranges normally from about 1 to 30 ips. In order to avoid a buildup of surface charge density on the roller, the surface velocity of the roller may be greater than that of the chargeable support, but it should not be less than three, and preferably not less than two, times slower than the velocity of the moving chargeable support. Particularly if the support speed is low, the roller speed could be much higher without running into difficulty. The above-noted 2–3 time speed factor limitations arise when the support speed is high, e.g., in the 20–50 ips range.

The current density delivered to the chargeable support depends on the charge acceptance of the support (which may be a function of the material used, its thickness, etc.), the relative speed of the charging roller and support, and the voltage of source 12; for present purposes the supply source voltage is contemplated to be in the 2–12 KV range. Typical current densities range from about ½–20 microamps per inch of roller length; in one example, for a selenium photoreceptor belt having a 60 micron thickness running about 20 ips, the desired current density would be on the order of 10 microamps per inch, producing a surface charge density on the selenium of about ½ microcoulomb per square inch.

The charge is deposited on support 14 in the following manner. Roller 10 is rotated at a given speed such that the field in the relaxable layer 32 increases, as a point on the roller surface moves from location A to location B, to a maximum before reaching location B, and collapses as the surface point moves from location B to location C. As the field in the layer 32 decreases, the field in the air gap d builds up and exceeds the air ionization threshold at or near location B. At this point current begins to flow across the gap and charges are deposited on the dielectric surface 14*a*. Since the power supply 12 controls the current/unit length of the roll, the charge density deposited on the dielectric surface will be given by $$\sigma = \frac{I}{L \cdot v},$$

where $I$ is the power supply current, $L$ is the length of the cylindrical roll 10 (which may be on the order of from 12 to 24 inches), and $v$ is the velocity at which the dielectric 14 passes under the roll. As long as the relaxable layer 32 thickness is large compared to the thickness of the dielectric material 14*a* being charged and the power supply and/or roller speed can compensate for the humidity variation of the roller material resistivity, $\rho$ will be constant. The feedback current control can be used to adjust the bias voltage, the roller surface velocity, or both to maintain the current at a constant value.

During the portion of the rotation cycle that the surface point moves from location A to location B, current flows through the relaxable core so that by the time the surface point reaches location B, most of the field is across the air gap and the voltage drop is transferred from the material to the air gap.

The bulk relaxation time of the relaxation layer 32 is determined as follows:

$$T_R = \epsilon_o \times k \times \rho$$

where $T_R$ = bulk relaxation time
$\epsilon_o$ = permittivity of free space
$k$ = dielectric constant of the layer material
$\rho$ = resistivity of the layer material Typically, the relaxation time is between one tenth and one half of the cycle time; for example, when the dielectric surface rate is 1 ips, the relaxation time $T_R$ may be as high as 0.5 second, although at higher surface rates the relaxation time must be much faster.

To prevent the necessity of very high voltage supplies, it is desired that the overcoat layer dielectric thickness (thickness divided by dielectric constant) be of the same order of magnitude as the dielectric thickness of the material to be charged. The overcoat layer 30 acts as a thin insulating layer coated on the surface of the relaxable core material to help protect the roll during air breakdown, to act as a moisture barrier, to limit current flow through the roll, and to make the roll surface easy to clean. However, if the relaxable material is durable and cleanable the overcoat layer 30 is not essential.

The dielectric overcoat 30 is also used to protect the system from catastrophic breakdown since a voltage will build up across the overcoat during the air ionization step. The overcoat resistivity is usually chosen so that the charge density on the insulator surface can be dissipated by bulk charge relaxation during one or two rotations of the roll. In a dirty environment it may be necessary to clean the roll surface with a blade or brush represented generally by reference numeral 38 in FIG. 1.

The device of this invention will deposit a constant surface charge density on the dielectric as long as the dielectric thickness of the material to be charged is much less than the thickness of the relaxable core.

A principal advantage of the present invention is that the charging roller does not have to be synchronized with the movement of the dielectric support. Therefore, whereas the materials used in contact type charging rollers must be carefully tailored to the particular application, the choice of roller materials for the present invention is much wider. Because the roller of this invention does not contact the support surface, the current density can be controlled by either changing the voltage and/or by changing the rotation rate of the roller. Thus more feedback latitude is provided to compensate for changes in the roll resistivity due to changes in ambient conditions (e.g. temperature and/or humidity).

A significant advantage of the non-contact charging roller over the corotron is that the former is easy to clean with a brush or blade; furthermore, the cleaning action is continuous as the roller rotates. This continuous cleaning action is not possible with currently used shielded wire corotrons.

It is to be understood that various modifications in the structural details of the preferred embodiment described herein may be made within the scope of this invention and without departing from the spirit thereof. It is intended that the scope of this invention shall be limited solely by the hereafter appended claims.

What is claimed is:

1. Apparatus for depositing a constant density surface charge on a moving dielectric medium, comprising:

a charging roller mounted adjacent to and spaced from said dielectric medium to define an ionizable air gap between the surface of said charging roller and said dielectric medium, said charging roller comprising an electrically relaxable insulator having a thickness which is greater than the thickness of said dielectric medium;

means for moving the surface of said charging roller in the same direction as, independently of, and relative to said dielectric medium; and variable electrical bias means coupled to said charging roller for generating an electric field in said air gap to charge said dielectric medium with a substantially constant density surface charge.

2. Apparatus according to claim 1, wherein said charging roller further comprises a conductive axle member overlaid with said relaxable insulator, said variable bias means being electrically coupled to said conductive axle member.

3. Apparatus according to claim 2, further comprising an overcoat layer substantially surrounding said relaxable layer and having a thickness which is substantially less than that of said relaxable layer.

4. Apparatus according to claim 3, wherein said relaxable layer is composed of a material having a resistivity in the range of from about $10^9$ ohm cm. to about $10^{13}$ ohm cm. and said overcoat layer is composed of a material having a resistivity in the range of from about $10^{11}$ ohm cm. to about $5 \times 10^{13}$ ohm cm.

5. Apparatus according to claim 3, wherein said axle has a diameter of approximately 0.125 inch, said relaxable layer has a thickness in the range of from about 0.25 to about 0.50 inch and said overcoat layer has a thickness in the range of about 0.002 to 0.003 inch.

6. Apparatus according to claim 1, wherein said means for moving said charging roller comprises means for varying the surface velocity of said roller relative to that of said moving dielectric medium.

7. Apparatus according to claim 6, wherein said charging roller surface velocity is variable over a range between a charging roller surface velocity which is greater than the surface velocity of said dielectric medium and a charging roller surface velocity which is no more than three times slower than said dielectric medium surface velocity.

8. Apparatus according to claim 7, wherein said charging roller surface velocity is not less than two times slower than said dielectric medium surface velocity.

9. Apparatus according to claim 1, wherein said charging roller is spaced from said dielectric medium in the region of said air gap a distance in the range from about 0.010 to about 0.060 inch.

10. Apparatus according to claim 1, further comprising means mounted adjacent to said charging roller for cleaning the moving surface of said charging roller.

11. Apparatus according to claim 2, wherein said variable bias means comprises a constant current supply for supplying a substantially constant current to said charging roller.

12. Apparatus according to claim 11, further comprising: means for sensing the current supplied to said charging roll by said supply means; and means coupled to said sensing means for adjusting the rotational rate of said charging roll as a function of the current supplied to said charging roll.

* * * * *